United States Patent [19]

Hampl, Jr.

[11] Patent Number: 4,739,775

[45] Date of Patent: Apr. 26, 1988

[54] WRAPPER CONSTRUCTIONS FOR SELF-EXTINGUISHING AND REDUCED IGNITION PROCLIVITY SMOKING ARTICLES

[75] Inventor: Vladimir Hampl, Jr., Roswell, Ga.

[73] Assignee: Kimberly-Clark Corporation, Neenah, Wis.

[21] Appl. No.: 912,723

[22] Filed: Sep. 26, 1986

[51] Int. Cl.[4] ..... A24D 1/02

[52] U.S. Cl. ..... 131/365; 131/349

[58] Field of Search ..... 131/365, 349, 336

[56] References Cited

U.S. PATENT DOCUMENTS

| | | |
|---|---|---|
| 1,581,451 | 4/1926 | Knapp . |
| 1,996,002 | 3/1935 | Seaman . |
| 1,999,222 | 4/1935 | Weinberger . |
| 2,013,508 | 9/1935 | Seaman . |
| 2,335,432 | 10/1940 | Millett . |
| 2,718,889 | 12/1945 | Claussen . |
| 2,998,012 | 7/1961 | Lamm . |
| 3,030,963 | 4/1962 | Cohn . |
| 3,165,105 | 3/1964 | Campbell . |
| 3,370,593 | 5/1967 | Owaki . |
| 3,409,021 | 11/1968 | Owaki . |
| 3,632,384 | 1/1972 | Saint-Pastou . |
| 3,633,589 | 1/1972 | Kahane . |
| 3,903,899 | 9/1975 | Musillo . |
| 4,061,147 | 12/1977 | Falchi . |
| 4,077,414 | 3/1978 | Baker et al. . |
| 4,452,259 | 6/1984 | Norman et al. . |
| 4,453,553 | 6/1984 | Cohn . |
| 4,480,650 | 11/1984 | Weinert . |

*Primary Examiner*—V. Millin

*Attorney, Agent, or Firm*—William D. Herrick

[57] ABSTRACT

Wrappers for smoking articles providing reduced ignition proclivity or self-extinguishing properties to the resultant smoking articles. The wrapper materials contain band areas of low inherent BMI in the range from about 0 to about 4 $cm^{-1}$. Preferred embodiments include wrappers wherein bands of paper material with reduced filler content are provided to produce a BMI in the range of from about 0 to about 2 $cm^{-1}$ in the band areas and the resulting smoking articles are self-extinguishing in the banded zones. The width of the bands may be in the range of from about 2 to about 20 millimeters and, for self-extinguishing properties, are preferably at least about 6 millimeters. The resulting smoking articles are also within the scope of the present invention.

14 Claims, 2 Drawing Sheets

WRAPPER CONSTRUCTIONS FOR SELF-EXTINGUISHING AND REDUCED IGNITION PROCLIVITY SMOKING ARTICLES

BACKGROUND OF THE INVENTION

1. Field of the Invention

The present invention relates to wrappers for smoking articles such as cigarettes and especially to such wrappers which reduce the tendency of cigarettes to cause ignition of surfaces which come in contact with the lit cigarette. Reports have been made of fires attributed to burning cigarettes coming in contact with combustible materials. Such reports have generated interest in reducing the tendency of cigarettes to ignite surfaces and materials included in furniture, bedding, and the like upon contact. One obviously desirable attribute of cigarettes in this regard would be that they extinguish themselves if left unattended for a period of time whether in an ash tray or in open air. Since it is recognized by those skilled in the art that the wrapper construction for the cigarette strongly influences the behavior of the cigarette during smolder, modification of the wrapper to achieve these desired results would be highly beneficial. In particular, a wrapper construction that does so without serious detrimental effects on desired smoking properties and characteristics would be especially advantageous. The present invention is directed to such wrapper constructions and improved smoking articles utilizing them.

2. Description of the Prior Art

The subject of reducing the tendency of cigarettes to ignite upholstery, bedding, and the like has received much attention.

Considerable effort has been directed to modifications of cigarette papers for the purpose of reducing fire hazards, including the development of non-burning wrappers, for example, as disclosed in U.S. Pat. No. 4,044,778 to Cohn dated Aug. 30, 1977.

It is also known, as in U.S. Pat. No. 4,231,377 to Cline dated Nov. 4, 1980, for example, to treat conventional wrappers with chemical adjuvants such as alkali metal citrates to control burn properties.

It is, moreover, known as described in copending and coassigned U.S. patent application Ser. No. 334,120 filed Dec. 24, 1981 now U.S. Pat. No. 4,461,311 issued July 24, 1984 to Mathews, DeLucia and Durocher that the addition of extraordinary amounts of burn promotion additives to cigarette paper leads to a reduced emission sidestream smoke. Cigarettes made with such papers normally would not have self-extinguishing properties, however.

Additionally, copending and coassigned U.S. patent application Ser. No. 627,711 filed July 11, 1984 now U.S. Pat. No. 4,615,345 issued Oct. 7, 1986 to D. F. Durocher describes wrapper constructions with specially designed paper structures and patterned application of burn enhancing compositions that yield cigarettes which self-extinguish in a predetermined amount of time if not puffed. Such cigarettes, however, require nonconventional cigarette wrappers as well as additional chemical additives which may affect taste.

U.S. Pat. No. 1,555,320 to Weil dated Sept. 20, 1925 describes a cigarette having one or more bands of tobacco leaf or treated paper to cause the cigarette to extinguish when discarded. Other patents having paper or board bands in various configurations are described in U.S. Pat. Nos. 2,666,437 to Lattof dated Jan. 19, 1954, 2,335,432 to Millet dated Nov. 30, 1943, and 1,581,451 to Knapp dated Apr. 20, 1926.

In summary it remains desired to produce wrapper constructions for cigarettes and the like that would result in a cigarette with reduced propensity to ignite substrates and a cigarette which reliably self-extinguishes in air after burning for a specified and controlled period of time. It is further desired to produce such wrapper constructions that accomplish this objective using conventional materials and without significant deleterious effects on desired smoking properties.

SUMMARY OF THE INVENTION

The present invention is directed to wrapper constructions for smoking articles such as cigarettes that impart reduced ignition proclivity properties, or which, if desired may be configured such that they reliably impart controlled self-extinguishing properties to such cigarettes even when free burning in air. In accordance with the invention this result is obtained with a smoking article wrapper construction that includes a normally burning cellulose fiber base web and one or more encircling bands of a cellulose fiber base web that normally will not sustain burn on a smoking article. Such smoking articles inherently are of reduced propensity to ignite surfaces or articles with which they come in contact such as by accidental dropping or the like. Smoking articles with wrappers of the present invention result in such benefits without a significant elevation in smoke delivery. By selection of the band width and inherent porosity, the resulting smoking article will be self-extinguishing. In accordance with the invention, the wrappers and smoking articles may be white, opaque, and attractive in appearance, machine well on high speed cigarette making machines and require no new or unproven ingredients.

In accordance with preferred embodiments of the invention, the cellulosic band material will have a structure defined by a "Burn Mode Index" (BMI), which is defined below and is a direct measure of a cigarette paper's ability to sustain continuous combustion of a cigarette supported in air. More specifically, they have a BMI between 0 and 4 $cm^{-1}$ in the cellulosic band. The bands may be attached by gluing, for example. In alternative embodiments the bands may be on the outside of the normal wrapper or may be on the inside for improved appearance. In accordance with the preferred embodiments of the invention, the normal cellulosic wrapper construction has one band or the bands applied in a plurality of selected zones with width and spacing selected to achieve the desired degree of ignition proclivity and free burn time, respectively.

When the band width is greater than about 6 mm and its BMI is less than about 2 $cm^{-1}$, the resulting cigarette will burn normally in air until the band is reached and will reliably self-extinguish thereafter if not puffed. Thus, normal or only slightly elevated deliveries of smoke and tars as well as normal puff counts may be attained while yet achieving the desired self-extinguishing properties. When the band width is narrower or the BMI is higher, reduced ignition proclivity properties will still be attained, but the cigarette may not self-extinguish in air.

DESCRIPTION OF THE PREFERRED EMBODIMENTS

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

In the description which follows, certain tests have been employed which were carried out in accordance with the hereinafter described procedures.

Figure 1:
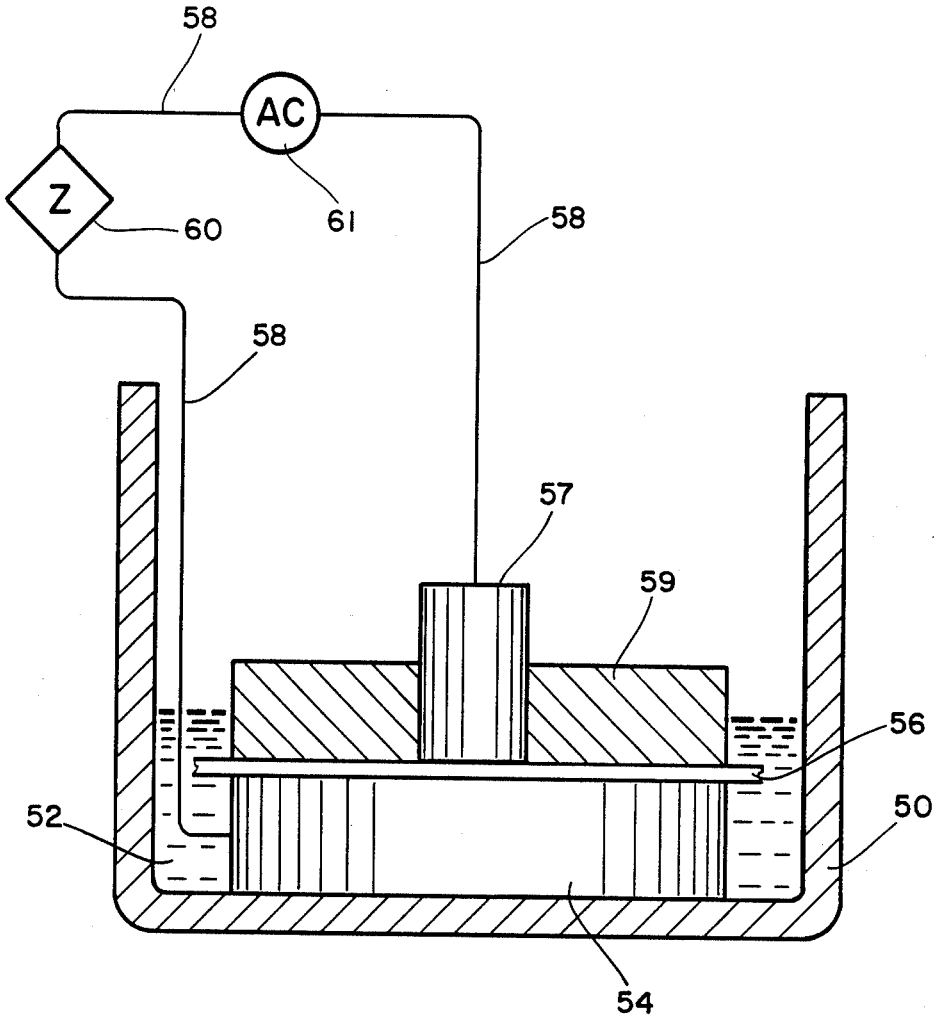
FIG. 1 depicts the apparatus for the determination of the Burn Mode Index.

The BMI test is based on the discovery that the wrapper's resistance to the flow of an electric current, when the paper is immersed in a non-aqueous solution of electrolyte and is placed between two electrodes, correlates very well with the ability of the wrapper to support combustion of a cigarette. The ratio of the intrinsic resistivity of the electrolyte solution (ohm-cm) to the product of the electrical resistance of the paper (ohm) and the area of paper in contact with both electrodes ($cm^2$) is defined as the "Burn Mode Index" (BMI). This electrical resistance was measured as a series resistance with an impedance bridge, Model 1658 manufactured by GenRad Corporation, using an alternating voltage at a 1 Khz frequency applied across the electrodes. The test cell is shown in FIG. 1. As shown therein, glass vessel 50 contains electrolyte 52, for example, 0.5 molar solution of tetraethylammonium chloride in butyrolactone. Bottom electrode 54, having a diameter of about 7.6 cm, for example, supports paper sample 56 upon which is placed a top electrode 57 having a diameter of about 1.4 cm, for example, and surrounded by nonconductive support 59 of, for example, Teflon (polytetrafluoroethylene). The electrodes are connected by wires 58 through impedance bridge 60 providing an alternating current of 1 Khz frequency. The electrodes may be, for example, gold-plated brass cylinders. The BMI is determined by dividing the intrinsic resistivity of the solution by the product of the measured resistance and the area of paper in contact with both electrodes (in the case described, area = 1.6 $cm^2$).

The ignition proclivity results were obtained by lighting a cigarette, allowing it to smolder in air until the coal was fully developed, and then placing it on top of the crease made by two cushions at right angles to each other. The cushions were designed to simulate the seat and backing of furniture such as sofas and chairs. This test is similar to that used by the Upholstered Furniture Action Committee (UFAC). Each cushion was made by wrapping a piece of standard, Class II cotton flannel, (UFAC) having a basis weight of 13.5 $oz/yd^2$, over a cushion of unfilled polyurethane foam (without fire retardant treatment), with a density of 1 $lb/ft^3$, 2 inches thick, 5 inches in width and 8 inches in length. Self-extinction of a cigarette as well as the extent of charring of the fabric were noted. In all such tests a standard cigarette 25 millimeters in circumference and 70 millimeters in tobacco column length, made from a standard American tobacco blend was tested.

The puff count was determined in accordance with standard FTC cigarette testing procedures. Carbon monoxide test results were obtained by gas chromatographic analysis of the smoke gas phase sampled during a puff.

The manufacture of paper for wrapping cigarettes is, of course, well established. Conventional practice employs traditional wet-laid manufacturing steps of fiber dispersion, dilution, deposition of a foraminous wire, water extraction, pressing, and drying. The fiber component for cigarette paper is preferably flax, but other cellulose fibers may be used instead of or in combination with flax. Mineral fillers such as precipitated calcium carbonate, ground limestone, calcined kaolinite, titania, diatomaceous earth, sodium silico aluminate, amorphous silica, calcium silicate, and others can be added for the purpose of producing desired appearance and opacity, for example. As will be recognized by those familar with papermaking, minerals of different particle size distribution, shape, and specific gravity may require alteration of fiber content or treatment such as refining or beating in order to obtain desired paper properties.

In accordance with the invention, however, it is required that the band wrapper material construction be controlled within carefully defined limits such that cigarettes utilizing it will have desired burn properties in the band zone or zones.

In order to obtain a desired level of reduction in the ignition proclivity of the smoking article, band materials of the present invention have an inherent BMI within the range of from about 0 to about 4 $cm^{-1}$ and more preferably the BMI is in the range of from about 0 to about 2 $cm^{-1}$. By "inherent BMI" it is meant that the test results are obtained without necessitating chemical treatment and are a function of the sheet composition and/or structure. For comparison BMI test values obtained on conventional wrappers are greater than 10 $cm^{-1}$ and usually are in excess of 15 $cm^{-1}$. The band width is in the range of from about 2 to 20 millimeters.

In order for the smoking article to have self-extinguishing properties, the band materials of the present invention have a BMI within the range of from about 0 $cm^{-1}$ to about 2 $cm^{-1}$. The band width is in such cases generally greater than about 6 millimeters.

Since the smoking article burns at a normal rate between the bands, the length of the wrapper between the banded zones will vary depending on the desired period of free burn. However, each smoking article will include at least one band.

While the base cigarette paper may be conventional, it may contain small amounts of an ash conditioner, such as potassium citrate. However, the amount of the ash conditioner must be below the level which causes the wrappers to support combustion of a cigarette in spite of the bands.

Attachment of the bands to the wrapper, as mentioned, may be on either surface, but preferably will be on the inside facing the tobacco charge so that the appearance of the cigarette will be normal. The bands may be adhered to the wrapper by various means, but preferably bonding is obtained by gluing or by hydrogen bonding. Adhesives such as are conventionally used to bond cigarette paper may be used, such as polyvinyl acetate, for example.

Figure 2:
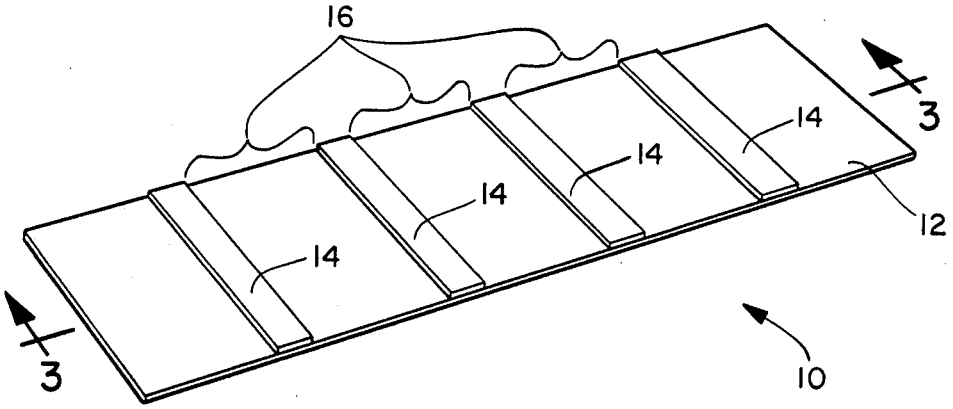
FIG. 2 illustrates a sheet of cigarette paper banded in accordance with one embodiment of the present invention.
Figure 3:
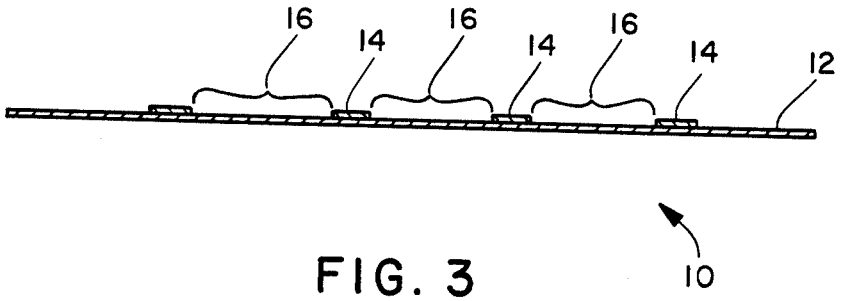
FIG. 3 is a cross-section of the sheet of FIG. 2 taken along lines 3—3.

Referring to FIGS. 2 and 3, one embodiment of wrapping paper in accordance with the present invention will be described. As shown, wrapper 10 includes base sheet 12 and band strips 14 attached at spaced intervals 16.

Cigarettes utilizing the above wrapper constructions exhibit a desirable rate and continuity of free burn in air within the unbanded zone. This unique combination of properties demonstrates the highly improved and unexpected results obtained in accordance with the invention. In contrast, prior "banded" cigarettes with zones treated with chemicals intended to make the cigarette nonburning, consistently failed to achieve a desired balance of these properties and, moreover, required additives that affected taste and performance. The benefits of this invention also include desired normal tar deliveries and normal puff counts while yet reducing the likelihood of ignition of combustible substrates from cigarettes, especially when compared with prior art approaches of treating the normally burning wrapper with zones of burn-inhibiting treatments.

Figure 4:
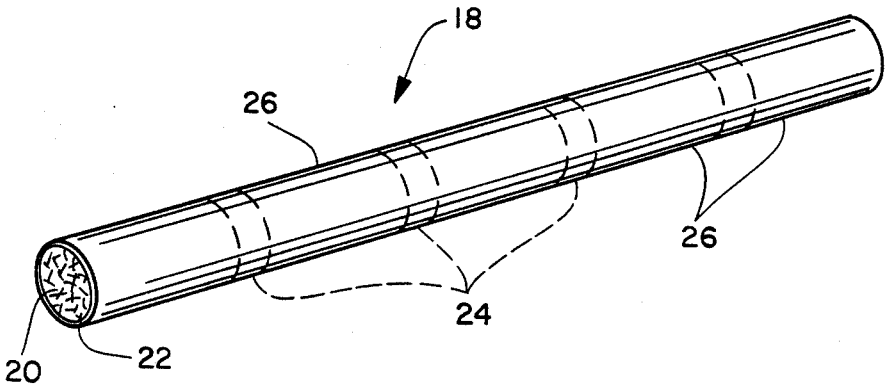
FIG. 4 illustrates a cigarette manufactured in accordance with the wrap construction of the invention showing representative banded and unbanded zones.

Referring to FIG. 4, smoking article 18 is shown as a cigarette comprising tobacco column 20, wrapper 22, and inner bands 24 spaced at intervals 26.

Thus, the wrapper and smoking article of the present invention comprises a conventional base construction having bonded thereto bands of paper in desired zones that will not support combustion and permits maximum flexibility and control of the cigarette burn characteristics. There is no significant elevation in smoke delivery or puff count. The wrapper construction promotes normal burn of the cigarette in air and in ash trays within the unbanded zone and a reliable self-extinction or at least a reduction in the ignition proclivity in the banded zone.

EXAMPLES OF THE INVENTION

Example 1

A cigarette wrapper material was manufactured on a standard Fourdrinier paper machine using conventional refining and forming techniques known in making lightweight papers. The furnish used was Kraft cooked, bleached flax pulp, and 30 percent chalk was added. This paper had the following characteristics: Permeability of 30 cm/min at 1 centibar (as measured by the CORESTA method), basis weight of 25 g/m$^2$, and BMI of 14 cm$^{-1}$. A small amount of potassium citrate, 8 mg of anhydrous potassium citrate per gram of bone dry base paper, was added to the paper to serve as an ash conditioner. Subsequently, bands of paper having a BMI of 0 cm$^{-1}$ made by similar techniques as the above conventional papermaking process but without chalk, were glued to the inner surface of the conventional base paper. These bands formed a repeating pattern consisting of 7 millimeter length bands with 15 millimeter length zones of the base paper.

Using standard cigarette manufacturing techniques, standard size, unfiltered cigarettes (25 mm circumference, 70 mm rod length) were made with this wrapper and a standard American tobacco blend with a density of 0.265 g/cm$^3$. These cigarettes were lit and allowed to free burn suspended in air. All burned continuously in the unbanded zones, but self-extinguished on reaching the first band of paper. Smoking results obtained by smoking a 43 mm length of each cigarette are shown in Table 1.

TABLE 1

TAR, CO, AND $CO_2$ DELIVERIES FOR SELF-EXTINGUISHING CIGARETTES.

| | Control | Example 1 | |
|---|---|---|---|
| Width of zones (mm) | — | 15 (base) | 7 (band) |
| CORESTA permeability (cm/min) | 30 | 30 (base) | 0 (band) |
| BMI (cm$^{-1}$) | 14 | 14 (base) | 0 (band) |
| Tobacco blend density (g/cm$^3$) | 0.265 | 0.265 | |
| Number of puffs | 8.0 | 8.9 | |
| Carbon monoxide per cigarette (cm$^3$) | 11.1 | 13.6 | |
| Carbon dioxide per cigarette (cm$^3$) | 27.2 | 30.7 | |
| Total particulate matter per cigarette (mg) | 23.6 | 27.5 | |

Example 2

Example 1 was repeated with bands of different width. The length of base paper between the bands was kept constant at 15 millimeters. The BMI of the band was also constant at 0 cm$^{-1}$. Results are summarized below. Reduction in charring refers to the approximate reduction in the area of charred fabric when the coal is in the banded zone. The reference is the charred area when the coal is in the zone of the base paper. If a cigarette self-extinguished in the simulated upholstery test, there was no further charring of the fabric and the reduction in amount of charred fabric was therefore 100 percent.

| Width of band (mm) | Self-extinction in air (%) | Reduction in charring of fabric in the band zone (%) |
|---|---|---|
| 2 | 0 | 25 |
| 3 | 0 | 50 |
| 5 | 50 | 75 |
| 7 | 100 | 100 |

Example 3

Example 1 was repeated except that the width of the banded zone was 7 and 10 millimeters and the BMI of the banded zones was 3 cm$^{-1}$. None of the cigarettes self-extinguished. The amount of charring of the fabric in the simulated upholstery test when the coal was in the banded zone was reduced by about 50 percent.

The improved wrapper constructions and smoking article of the present invention can be made by application of existing papermaking and printing or coating technologies as will be apparent to those skilled in these arts. Achieving the sheet characteristics required to obtain the BMI values prescribed for the preferred embodiments may be accomplished by selection of fiber beating conditions and by control of the amounts and morphologies of mineral fillers incorporated in the paper.

Thus, it is apparent that there has been provided in accordance with the invention a wrapper for smoking articles and smoking articles that fully satisfy the objectives, aims, and advantages set forth above. Although the inventions has been described in conjunction with specific embodiments thereof, it is evident that many alternatives, modifications, and variations will be apparent to those skilled in the art in the light of the foregoing description. Accordingly, it is intended to embrace all such alternatives, modifications, and variations as fall within the spirit and broad scope of the appended claims.

I claim:

1. Smoking article wrapper comprising a base web of normally burning cellulose fiber paper having one or more bands of a width in the range of from about 2 to 20 millimeters, said wrapper within said one or more bands having an inherent BMI in the range of from about 0 to about 4 $cm^{-1}$ whereby said wrapper causes a wrapped smoking article to have reduced ignition proclivity when burning within said one or more bands while exhibiting desirable rate and continuity of free burn in air when burning outside of said one or more bands.

2. The smoking article wrapper of claim 1 wherein the inherent BMI is in the range of from about 0 to about 2 $cm^{-1}$.

3. The smoking article wrapper of claim 1 wherein the inherent BMI is in the range of from about 2 to about 4 $cm^{-1}$.

4. The smoking article wrapper of claim 2 wherein the band width is in the range of from about 6 to about 20 millimeters.

5. The smoking article wrapper of claim 1 wherein the band width is in the range of from about 2 to about 6 millimeters.

6. The smoking article wrapper of claim 1 including a plurality of said bands.

7. The smoking article wrapper of claim 4 including a plurality of said bands.

8. The smoking article wrapper of claim 1 wherein said bands comprise cellulose fiber paper containing a reduced level of fillers.

9. The smoking article wrapper of claim 4 wherein said bands comprise cellulose fiber paper containing a reduced level of fillers.

10. A smoking article comprising a tobacco column and a wrapper comprising a base web of normally burning cellulose fiber paper having one or more bands of a width in the range of from about 2 to 20 millimeters, said wrapper within said one or more bands having an inherent BMI in the range of from about 0 to about 4 $cm^{-1}$ whereby said wrapper causes said smoking article to have reduced ignition proclivity when burning within said one or more bands while exhibiting a desirable rate and continuity of free burn in air when burning outside of said one or more bands.

11. The smoking article of claim 10 wherein the inherent BMI is in the range of from about 0 to about 2 $cm^{-1}$ and the band width is in the range of from about 6 to about 20 millimeters.

12. The smoking article of claim 10 wherein the band width is in the range of from about 2 to about 6 millimeters.

13. The smoking article of claim 11 including a plurality of bands of paper containing a reduced level of fillers.

14. The smoking article of claim 10 wherein the band width is in the range of from about 2 to about 6 millimeters.

* * * * *